US011732882B1

(12) United States Patent
Wu

(10) Patent No.: US 11,732,882 B1
(45) Date of Patent: Aug. 22, 2023

(54) ILLUMINATING KNITTED HAT

(71) Applicant: Qinglong Wu, Haikou (CN)

(72) Inventor: Qinglong Wu, Haikou (CN)

(73) Assignee: Qinglong Wu, Haikou (CN)

( * ) Notice: Subject to any disclaimer, the term of this patent is extended or adjusted under 35 U.S.C. 154(b) by 0 days.

(21) Appl. No.: 18/177,784

(22) Filed: Mar. 3, 2023

(51) Int. Cl.

| | |
|---|---|
| ***F21V 33/00*** | (2006.01) |
| ***F21V 23/04*** | (2006.01) |
| ***F21V 15/01*** | (2006.01) |
| ***A42B 1/242*** | (2021.01) |
| ***F21V 23/02*** | (2006.01) |
| ***F21V 23/06*** | (2006.01) |
| ***F21V 14/00*** | (2018.01) |

(52) U.S. Cl.
CPC ..... *F21V 33/0008* (2013.01); *A42B 1/242* (2013.01); *F21V 14/003* (2013.01); *F21V 15/01* (2013.01); *F21V 23/023* (2013.01); *F21V 23/0435* (2013.01); *F21V 23/06* (2013.01)

(58) Field of Classification Search
CPC .... F21V 33/0008; F21V 14/003; F21V 15/01; F21V 23/023; F21V 23/0435; F21V 23/06; A42B 1/242; A42B 1/244; A42B 1/04
See application file for complete search history.

(56) References Cited

U.S. PATENT DOCUMENTS

| | | | | |
|---|---|---|---|---|
| 9,526,287 | B2 * | 12/2016 | Waters | A42B 1/244 |
| 11,543,107 | B1 * | 1/2023 | Guo | F21V 33/0008 |
| 2014/0049947 | A1 * | 2/2014 | Lombard | A41D 19/0157 362/105 |
| 2022/0061444 | A1 * | 3/2022 | Gibson | F21V 21/084 |

FOREIGN PATENT DOCUMENTS

| | | | |
|---|---|---|---|
| CN | 202407252 | U | 9/2012 |
| CN | 202618427 | U | 12/2012 |
| CN | 109937324 | A | 6/2019 |
| WO | WO 2017174031 | * | 10/2017 |

OTHER PUBLICATIONS

WO 2017174031, Chang Ming Yang, Oct. 12, 2017, English Translation (Year: 2017).*

* cited by examiner

*Primary Examiner* — Peggy A Neils
(74) *Attorney, Agent, or Firm* — Nitin Kaushik

(57) ABSTRACT

The present invention relates to an illuminating knitted hat comprising a hat body and an illuminating structure, wherein the illuminating structure comprises a light-condensing component, a light-scattering component and a main control circuit board, wherein a switching button is connected to a surface of the main control circuit board, and a charging interface is connected to the main control circuit board; by applying a pressing force to the switching button, the main control circuit board and lampwicks or a light panel are powered on to form a loop, so that the lampwicks are powered on to emit condensed light or the light panel is powered on to emit scattered light, thereby achieving the effect of illuminating, achieving the function of a condensing light by a downlight or illuminating by scattering light, increasing the illuminating range or scope.

9 Claims, 7 Drawing Sheets

ILLUMINATING KNITTED HAT

TECHNICAL FIELD

The present invention relates to the technical field of knitted hats, in particular to an illuminating knitted hat.

BACKGROUND

A knitted hat is a hat commonly used in cold weather and suitable for people of all ages. The hat is knitted from wool, so it is called a knitted hat. With the progress of society and the development of science and technology, the accessories and additional functions installed on the surface of the knitted hat can be configured according to the user's different preferences, including the illuminating knitted hat. The existing illuminating knitted hat can only be used for illumination, and there is no added effect of diversifying the illumination, such as making the illumination function achieve the function of light condensation and scattering. Therefore, the structure of the illuminating knitted hat still needs to be improved. In addition, most of the existing illuminating knitted hats adopt an integrated structure, so that the illumination lamp cannot be taken out from the surface of the knitted hat, and when it needs to be replaced, the whole needs to be replaced, which increases costs for replacement.

At present, reference can be made to Chinese patent publication number CN 212911889U, which discloses a knitted hat integrating music playing, illuminating and warning functions, comprising a knitted hat body, wherein a hat brim is provided at a lower end of the knitted hat body, two sides of the hat brim are symmetrically provided with an accommodating cavity, a Bluetooth primary earphone and a Bluetooth secondary earphone are respectively provided in the accommodating cavity, a rubber collar is sewn on the hat brim at a middle position between the Bluetooth primary earphone and the Bluetooth secondary earphone, an illuminating warning device is detachably clamped in the rubber collar, and the Bluetooth primary earphone and the Bluetooth secondary earphone are electrically connected via an electric wire. The knitted hat of the present invention integrates music playing, illuminating, and warning functions, has a compact structure, rich functions, is convenient to use and has a strong practicality, can provide an effective illuminating or warning effect in a dark environment, greatly improves user experience, combines multiple functions into one, and reduces the user's use cost.

Although the patent has illuminating and warning functions, it does not have the effect of making the illuminating function achieve light condensation and scattering. When it is required to be used in a specific environment, such as when it is required to use light flickering as distress information and when it is required to change the light into a soft illuminating state, since the patent structure does not add a relevant structure for making the illuminating function achieve light condensation and scattering, further processing and improving the structure are required when it is used. Therefore, the inventor provides an illuminating knitted hat to solve the above-mentioned technical problem.

SUMMARY

The present invention has been made to overcome the above-mentioned problems, and aims to provide a technical solution capable of solving the above-mentioned problems.

An illuminating knitted hat, comprising a hat body and an illuminating structure, wherein one end of the hat body is a folded-edge portion, the illuminating structure is mounted on the surface of the folded-edge portion, the illuminating structure comprises a light-condensing component, a light-scattering component and a main control circuit board, a switching button is electrically connected to the surface of the main control circuit board, the switching button is used for switching the light-condensing or light-scattering function, a protection component for protecting the illuminating structure is mounted on the outside of the illuminating structure, the protection component is mounted on the surface of the folded-edge portion, and one end of the main control circuit board is electrically connected to a charging interface for connecting an external power supply.

Further, the light-condensing component is composed of a plurality of lampwicks used for illumination, the lampwicks are rectangular, arranged in a rectangular array, are electrically connected to a main control circuit board, and can achieve a light-condensing function when being powered on with the main control circuit board; and when a pressing force is applied to the switching button, the main control circuit board and the lampwicks are powered on to form a loop through the switching button, so that the lampwicks are powered on to emit condensed light for illumination, achieving the function of the condensing light by a downlight, and increasing the illumination range of the lamp light.

Further, the light-scattering component is composed of a light panel used for illumination; the light panel is in a rectangular plate shape, electrically connected with the main control circuit board and can achieve a light-scattering function when being powered on with the main control circuit board; when a pressing force is applied to the switching button, the main control circuit board and the light panel are powered on to form a loop through the switching button, so that the light panel is powered on to emit scattered light for illumination, achieving the function of scattering light, and increasing the illumination range of light.

Further, the protection component comprises a protection shell and a protection cushion which are both in an annular scaling shape, the edges of the protection shell and the protection cushion are both arc shaped, one end of the protection cushion is connected to a storage battery electrically connected to a main control circuit board, and the storage battery is used for storing an external power source connected to a charging interface; the protection shell is mounted at one end of a folded-edge portion, the protection cushion is mounted at the other end of the folded-edge portion, and when the charging interface is connected to the external power source, an auxiliary current is transmitted to the inside of the storage battery via the main control circuit board, so that the storage battery completes the function of storing electric energy, facilitating subsequent use by the user; the protection shell and the protection cushion both play the role of protecting the illuminating structure; when an external object has an impact force on the edge of the illuminating structure, the protection shell and the protection cushion play the role of buffering the impact force, thereby reducing the impact force on the edge of the illuminating structure to achieve the effect of reducing damage.

Further, a bluetooth positioning module is electrically connected to the surface of the main control circuit board and is used for assisting wireless positioning of a signal, one end of the main control circuit board is provided with a rectifying diode electrically connected thereto, the rectifying diode is provided with a plurality of strips, and two adjacent rectifying diodes are arranged equidistantly; the rectifier diode is a semiconductor device for converting alternating current energy into direct current energy, the rectifier diode comprises a PN junction, and has two terminals of a positive electrode and a negative electrode, and the most important characteristic of the rectifier diode is one-way conductivity. In a circuit, the current can only flow in from the positive electrode and the negative electrode of the rectifier diode to maintain the stability of the current, play the role of sorting the current, and achieve the effect of avoiding the load or overload of the main control circuit board:

The Bluetooth positioning module uses the RSSI positioning principle, and the Bluetooth positioning is based on the Received Signal Strength Indication (RSSI) positioning principle; according to different positioning ends, the Bluetooth positioning modes are divided into network side positioning and terminal side positioning;

a network side positioning system is composed of a terminal (a terminal with low-power Bluetooth such as a mobile phone), a Bluetooth beacon node, a Bluetooth gateway, a wireless local area network and a back-end data server, and the specific positioning process thereof is:

1) firstly, the beacon and Bluetooth gateways are laid in the region;

2) when a terminal enters a beacon signal coverage range, the terminal can sense a broadcast signal of the beacon, and then calculate a RSSI value under a certain beacon, and transmit same to a back-end data server via a Bluetooth gateway via a WiFi network, and calculate a specific position of the terminal via a built-in positioning algorithm of the server;

Terminal side positioning system is composed of terminal device (such as mobile phone embedded with SDK software package) and beacon. Its specific positioning principle is:

1) firstly, a Bluetooth beacon is laid in an area:

2) beacon continuously broadcasts signals and data packets to the surroundings;

3) when a terminal device enters a range covered by a beacon signal, RSSI values thereof for different base stations are measured, and then a specific position is calculated via a built-in positioning algorithm of a mobile phone.

All the devices connected together by Bluetooth technology are referred to as a piconet, and a plurality of piconets can be connected together; each piconet is identified by a frequency hopping sequence, and all users of the same piconet are synchronized with this frequency hopping sequence; piconet refers to a micro-network composed of various electric appliances with a Bluetooth unit (i.e., a Bluetooth positioning module embedded in various electric appliance devices supporting Bluetooth technology) in a small range (10-100 m) using Bluetooth technology, commonly referred to as a piconet;

a piconet is composed of 2-8 Bluetooth units, i.e., a piconet composed of one main appliance and other 2-7 secondary appliances can be composed; these appliances may be PCs, printers, fax machines, digital cameras, mobile phones, notebook computers, etc.; a plurality of piconets can also be interconnected to form a Scatternet to conveniently and quickly realize the communication between various types of devices at any time and anywhere; a path is formed by a Bluetooth positioning module and a separate contact on a main control circuit board, so that the Bluetooth positioning module sends out a wireless signal; when an external sensor senses a wireless signal, an external positioning device in a standby state is activated.

After the wireless signal monitored by the external positioning device is converted into an electrical signal by baseband chip analysis processing, the signal is transmitted to the positioning controller through the radio frequency chip, and thereafter the working mode is controlled by wired control; after the wireless signal is centrally determined, processed, calculated and confirmed by the external controller, corresponding positioning and control work is performed, and the positioning process through the Bluetooth positioning module is completed.

Further, a reinforcement portion for reinforcing the hat body is connected to the edge of the hat body, the arc of the reinforcement portion coincides with the arc of the hat body, and one end of the reinforcement portion extends to an edge of the folded-edge portion and abuts against the edge of the folded-edge portion; increasing the thickness of the edge of the hat body by the reinforcement portion has the effect of supporting the hat body as a whole, achieving the function of stabilizing the hat body, relieving collapses of the hat body when standing, and having the effect of increasing practicality, and at the same time, reducing the probability of deformation of the hat body by the reinforcement portion when wearing, and having the effect of improving aesthetics.

Further, the surface of the folded-edge portion is provided with a plurality of contact threads for increasing friction, wherein the contact threads are in an annular sealing shape, and two adjacent contact threads are arranged at an equal distance; the contact threads serve to increase the contact point between the surface of the folded-edge portion and the surface of the hat body, thereby serving to increase the friction, reduce the phenomenon that the folded-edge portion slides off from the surface of the hat body, facilitate daily use of the hat body and facilitate finishing by a user, and reduce the process of finishing the folded-edge portion sliding off; one end of the folded-edge portion away from the illuminating structure is provided with a storage bag, and structure of the storage bag is symmetrically mounted on the surface of the folded-edge portion; one end of the storage bag is opened, and the interior of the storage bag can hold an article, wherein the article comprises a paper, a coin, a signature pen or a card.

Further, the hat body and the illuminating structure are detachable structures, the hat body is a foldable structure, and the top of the hat body is are shaped; when it is necessary to remove the illuminating structure from the hat body, by applying an acting force to the illuminating structure, the illuminating structure is detached from the surface of the folded-edge portion by the acting force, thereby detaching the illuminating structure from the hat body, and completing the step of detaching the illuminating structure to facilitate subsequent steps of cleaning, arranging, folding or containing the hat body.

Further, the surface of the main control circuit board is provided with a transfer contact located in the middle of the main control circuit board and is electrically connected to the main control circuit board, and the transfer contact is used for switching the power supply of the light-condensing component or the light-scattering component; when the transfer contact and the light-condensing component are powered on to form a loop, the light-condensing component is powered on to generate condensed light for illumination by connecting the power supply; and when the transfer contact and the light-scattering component are powered on to form a loop, the light-scattering component is powered on to generate scattered light for illumination by being switched on.

Further, a protection component is provided outside the charging interface; the protection component comprises a sheath and anti-slip threads, wherein the sheath and the charging interface are of a detachable structure, the anti-slip threads are located on the surface of the sheath, used for increasing the friction force on the surface of the sheath, and provided with a plurality of strips, two adjacent anti-slip threads are equidistantly arranged, one end of the sheath is arc shaped, one end of the folded-edge portion can fold along the surface of the hat body, the illuminating structure penetrates the surfaces of the two ends of the folded-edge portion, and the hat body is composed of a knitted hat, and the illuminating structure can be replaced with a LED lamp.

Compared to the prior art, the advantageous effects of the present invention are: by applying a pressing force to the switching button, the main control circuit board and lampwicks or a light panel are powered on to form a loop, so that the lampwicks are powered on to emit condensed light or the light panel is powered on to emit scattered light, thereby achieving the effect of illuminating, achieving the function of a condensing light by a downlight or illuminating by scattering light, increasing the illuminating range or scope.

In addition, the hat body and the illuminating structure are of detachable structures; when it is necessary to remove the illuminating structure from the hat body, by applying an acting force to the illuminating structure, the illuminating structure is detached from the surface of the folded-edge portion by the acting force, thereby detaching the illuminating structure from the hat body, and completing the step of detaching the illuminating structure to facilitate subsequent steps of cleaning, arranging, folding or containing the hat body.

In the figure: 1—hat body, 2—folded-edge portion, 3—main control circuit board, 4—switching button, 5—charging interface, 6—sheath, 7—anti-slip thread, 8—lampwick, 9—light panel, 10—protection shell, 11—protection cushion, 12—storage battery, 13—Bluetooth positioning module, 14—rectifier diode, 15—reinforcement portion, 16—contact thread, 17—storage bag, 18—transfer contact.

DETAILED DESCRIPTION OF THE EMBODIMENTS

The invention will now be further described in detail with reference to the accompanying drawings and detailed description.

Example I

Figure 1:
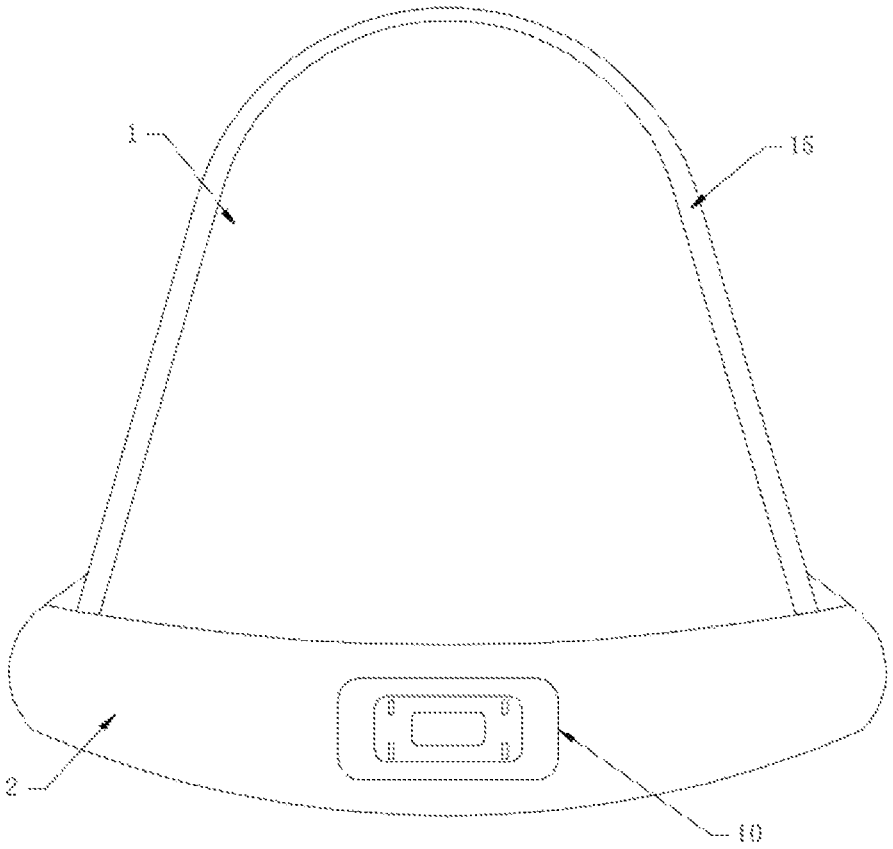
FIG. 1 is a front view of an illuminating knitted hat.
Figure 2:
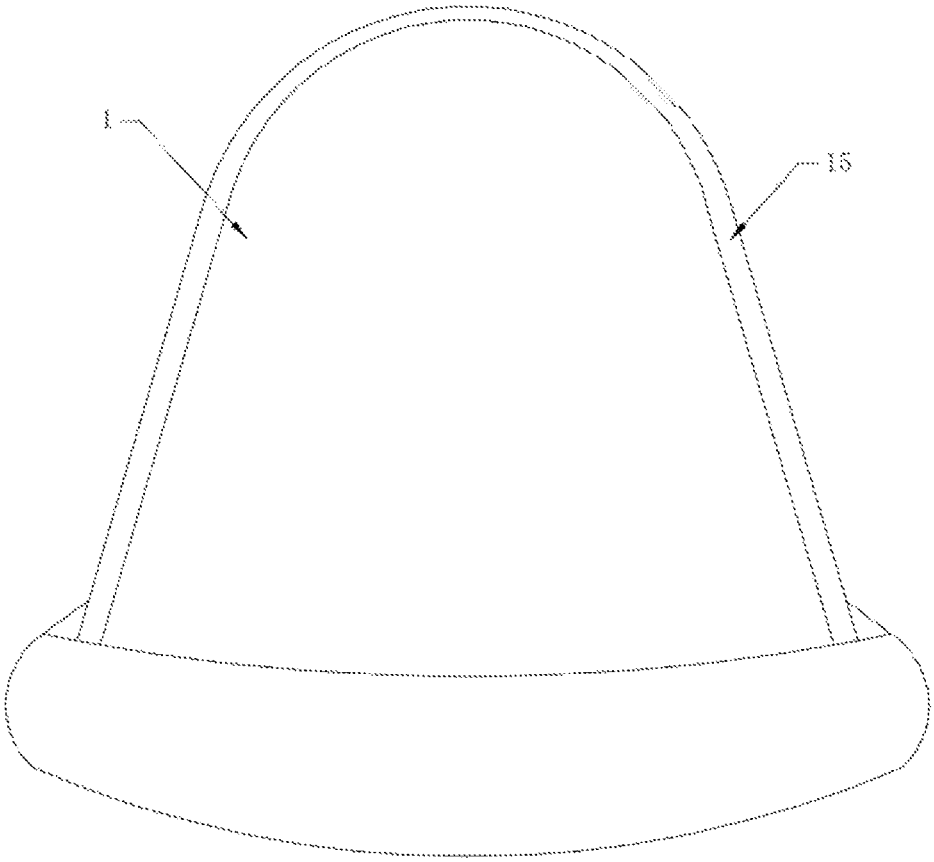
FIG. 2 is a rear view of an illuminating knitted hat.
Figure 3:
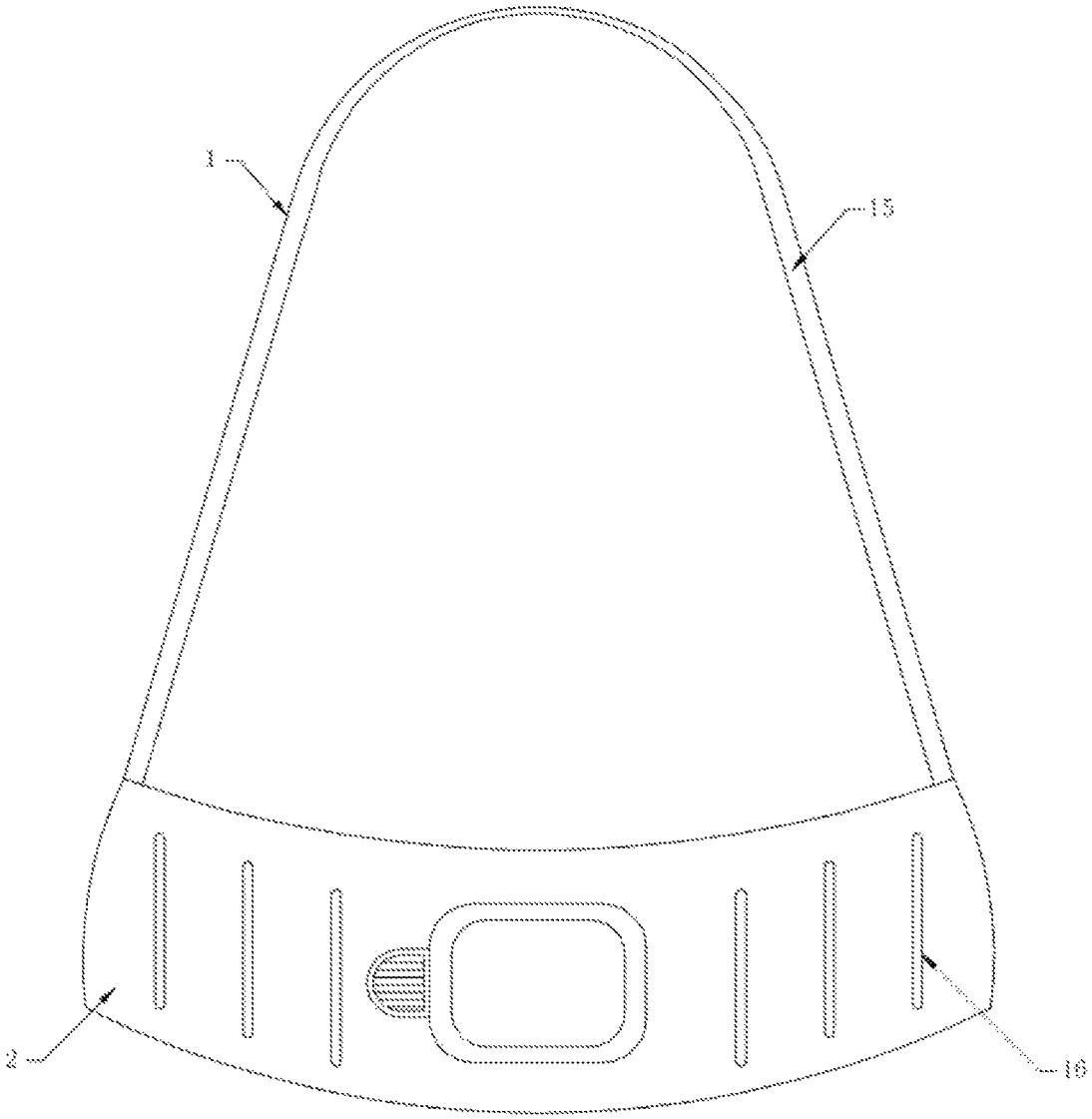
FIG. 3 is an exploded front view of an illuminating knitted hat.
Figure 4:
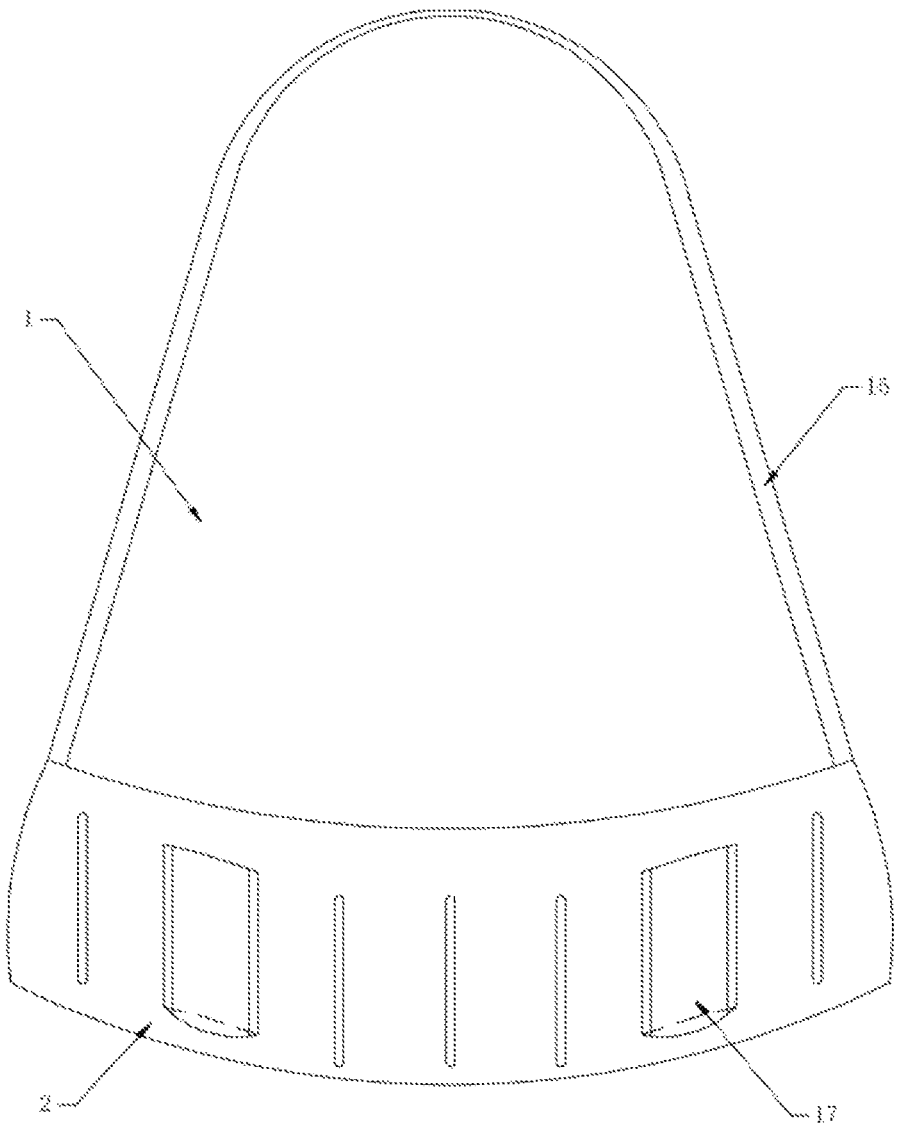
FIG. 4 is an exploded rear view of an illuminating knitted hat.
Figure 5:
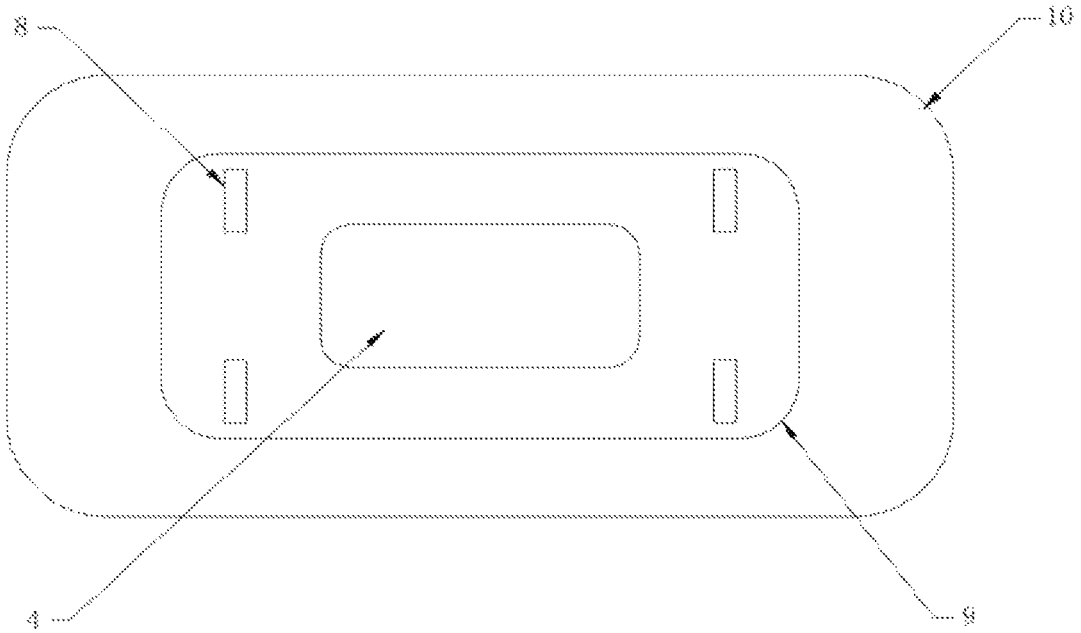
FIG. 5 is a front view of an illuminating structure in an illuminating knitted hat.
Figure 6:
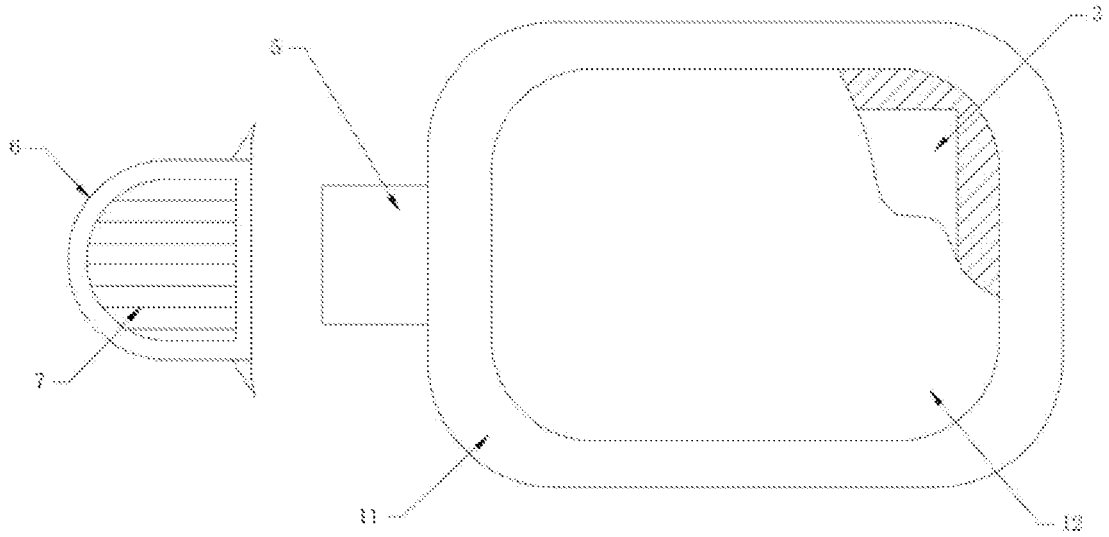
FIG. 6 is a rear view of a shield component in an illuminating knitted hat.
Figure 7:
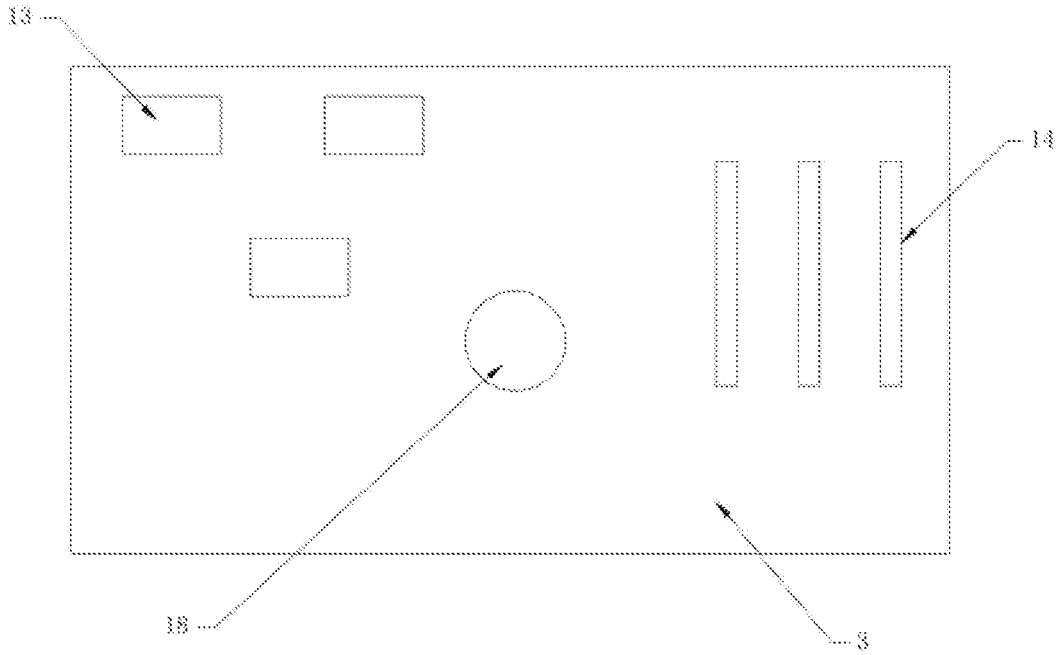
FIG. 7 is a front view of a main control circuit board in an illuminating knitted hat.

With reference to FIGS. 1-7, in this embodiment, an illuminating knitted hat is implemented, comprising a hat body 1 and an illuminating structure, wherein one end of the hat body 1 is a folded-edge portion 2, the illuminating structure is mounted on the surface of the folded-edge portion 2, the illuminating structure comprises a light-condensing component, a light-scattering component and a main control circuit board 3, a switching button 4 is electrically connected to the surface of the main control circuit board 3, the switching button 4 is used for switching the light-condensing or light-scattering function, a protection component for protecting the illuminating structure is mounted on the outside of the illuminating structure, the protection component is mounted on the surface of the folded-edge portion 2, and one end of the main control circuit board 3 is electrically connected to a charging interface 5 for connecting an external power supply, and a protection component is provided outside the charging interface 5.

The protection component comprises a sheath 6 and anti-slip threads 7, wherein the sheath 6 and the charging interface 5 are of a detachable structure, the anti-slip thread 7 is located on the surface of the sheath 6, the anti-slip thread 7 is used for increasing the friction force on the surface of the sheath 6, the anti-slip thread 7 is provided with a plurality of strips, two adjacent anti-slip threads 7 are equidistantly arranged, one end of the sheath 6 is arc shaped, one end of the folded-edge portion 2 can fold along the surface of the hat body 1, the illuminating structure penetrates the surfaces of the two ends of the folded-edge portion 2, and the hat body 1 is composed of a knitted hat, and the illuminating structure can be replaced with a LED lamp.

The light-condensing component is composed of a plurality of lampwicks 8 used for illumination, the lampwicks 8 are rectangular, arranged in a rectangular array, are electrically connected to a main control circuit board 3, and can achieve a light-condensing function when being powered on with the main control circuit board 3; and when a pressing force is applied to the switching button 4, the main control circuit board 3 and the lampwicks 8 are powered on to form a loop through the switching button 4, so that the lampwicks 8 are powered on to emit condensed light for illumination, achieving the function of the condensing light by a downlight, and increasing the illumination range of the lamp light.

The protection component comprises a protection shell 10 and a protection cushion 11 which are both in an annular scaling shape, the edges of the protection shell 10 and the protection cushion 11 are both arc shaped, one end of the protection cushion 11 is connected to a storage battery 12 electrically connected to a main control circuit board 3, and the storage battery 12 is used for storing an external power source connected to a charging interface 5; the protection shell 10 is mounted at one end of a folded-edge portion 2, the protection cushion 11 is mounted at the other end of the folded-edge portion 2, and when the charging interface 5 is connected to the external power source, an auxiliary current is transmitted to the inside of the storage battery 12 via the main control circuit board 3, so that the storage battery 12 completes the function of storing electric energy, facilitating subsequent use by the user; the protection shell 10 and the protection cushion 11 both play the role of protecting the illuminating structure: when an external object has an impact force on the edge of the illuminating structure, the protection shell 10 and the protection cushion 11 play the role of buffering the impact force, thereby reducing the impact force on the edge of the illuminating structure to achieve the effect of reducing damage.

A bluetooth positioning module 13 is electrically connected to the surface of the main control circuit board 3 and is used for assisting wireless positioning of a signal, one end of the main control circuit board 3 is provided with a rectifying diode 14 electrically connected thereto, the rectifying diode 14 is provided with a plurality of strips, and two adjacent rectifying diodes 14 are arranged equidistantly; the rectifier diode is a semiconductor device for converting alternating current energy into direct current energy, the rectifier diode comprises a PN junction, and has two terminals of a positive electrode and a negative electrode, and the most important characteristic of the rectifier diode is conductivity. In a circuit, the current can only flow in from the positive electrode and the negative electrode of the rectifier diode 14 to maintain the stability of the current, play the role of sorting the current, and achieve the effect of avoiding the load or overload of the main control circuit board 3.

The Bluetooth positioning module 13 uses the RSSI positioning principle, and the Bluetooth positioning is based on the Received Signal Strength Indication (RSSI) positioning principle; according to different positioning ends, the Bluetooth positioning modes are divided into network side positioning and terminal side positioning;

a network side positioning system is composed of a terminal (a terminal with low-power Bluetooth such as a mobile phone), a Bluetooth beacon node, a Bluetooth gateway, a wireless local area network and a back-end data server, and the specific positioning process thereof is:

1) firstly, the beacon and Bluetooth gateways are laid in the region;

2) when a terminal enters a beacon signal coverage range, the terminal can sense a broadcast signal of the beacon, and then calculate a RSSI value under a certain beacon, and transmit same to a back-end data server via a Bluetooth gateway via a WiFi network, and calculate a specific position of the terminal via a built-in positioning algorithm of the server;

Terminal side positioning system is composed of terminal device (such as mobile phone embedded with SDK software package) and beacon. Its specific positioning principle is:

1) firstly, a Bluetooth beacon is laid in an area;

2) beacon continuously broadcasts signals and data packets to the surroundings;

3) when a terminal device enters a range covered by a beacon signal, RSSI values thereof for different base stations are measured, and then a specific position is calculated via a built-in positioning algorithm of a mobile phone.

All the devices connected together by Bluetooth technology are referred to as a piconet, and a plurality of piconets can be connected together; each piconet is identified by a frequency hopping sequence, and all users of the same piconet are synchronized with this frequency hopping sequence; piconet refers to a micro-network composed of various electric appliances with a Bluetooth unit (i.e., a Bluetooth positioning module embedded in various electric appliance devices supporting Bluetooth technology) in a small range (10-100 m) using Bluetooth technology, commonly referred to as a piconet;

a piconet is composed of 2-8 Bluetooth units, i.e., a piconet composed of one main appliance and other 2-7 secondary appliances can be composed; these appliances may be PCs, printers, fax machines, digital cameras, mobile phones, notebook computers, etc.; a plurality of piconets can also be interconnected to form a Scatternet to conveniently and quickly realize the communication between various types of devices at any time and anywhere; a path is formed by a Bluetooth positioning module 13 and a separate contact on a main control circuit board 3, so that the Bluetooth positioning module 13 sends out a wireless signal; when an external sensor senses a wireless signal, an external positioning device in a standby state is activated.

After the wireless signal monitored by the external positioning device is converted into an electrical signal by baseband chip analysis processing, the signal is transmitted to the positioning controller through the radio frequency chip, and thereafter the working mode is controlled by wired control: after the wireless signal is centrally determined, processed, calculated and confirmed by the external controller, corresponding positioning and control work is performed, and the positioning process through the Bluetooth positioning module 13 is completed.

A reinforcement portion 15 for reinforcing the hat body 1 is connected to the edge of the hat body 1, the arc of the reinforcement portion 15 coincides with the arc of the hat body 1, and one end of the reinforcement portion 15 extends to an edge of the folded-edge portion 2 and abuts against the edge of the folded-edge portion 2; increasing the thickness of the edge of the hat body 1 by the reinforcement portion 15 has the effect of supporting the hat body 1 as a whole, achieving the function of stabilizing the hat body 1, relieving collapses of the hat body 1 when standing, and having the effect of increasing practicality, and at the same time, reducing the probability of deformation of the hat body 1 by the reinforcement portion 15 when wearing, and having the effect of improving aesthetics.

The surface of the folded-edge portion 2 is provided with a plurality of contact threads 16 for increasing friction, wherein the contact threads 16 are in an annular sealing shape, and two adjacent contact threads 16 are arranged at an equal distance; the contact threads 16 serve to increase the contact point between the surface of the folded-edge portion 2 and the surface of the hat body 1, thereby serving to increase the friction, reduce the phenomenon that the folded-edge portion 2 slides off from the surface of the hat body 1, facilitate daily use of the hat body 1 and facilitate finishing by a user, and reduce the process of finishing the folded-edge portion 2 sliding off; one end of the folded-edge portion 2 away from the illuminating structure is provided with a storage bag 17, and structure of the storage bag 17 is symmetrically mounted on the surface of the folded-edge portion 2; one end of the storage bag 17 is opened, and the interior of the storage bag 17 can hold an article, wherein the article comprises a paper, a coin, a signature pen or a card.

The hat body 1 and the illuminating structure are detachable structures, the hat body 1 is a foldable structure, and the top of the hat body 1 is arc shaped; when it is necessary to remove the illuminating structure from the hat body 1, by applying an acting force to the illuminating structure, the illuminating structure is detached from the surface of the folded-edge portion 2 by the acting force, thereby detaching the illuminating structure from the hat body 1, and completing the step of detaching the illuminating structure to facilitate subsequent steps of cleaning, arranging, folding or containing the hat body 1.

A transfer contact 18 is provided on the surface of the main control circuit board 3 and is located in the middle of the main control circuit board 3 and is electrically connected to the main control circuit board 3, the transfer contact 18 is used for switching the power supply of the light-condensing component, and when the transfer contact 18 and the light-condensing component are powered on to form a loop, the light-condensing component is powered on to generate light for illumination by being switched on.

The point of this embodiment is that the main control circuit board 3 and the lampwicks 8 are powered on to form a loop by switching the button 4, so that the lampwicks 8 are powered on to emit condensed light to achieve the function of condensing light by a downlight, increasing the illumination range of the lamp light and increasing the practicality of the product; at the same time, by setting the light condensation as a flickering effect, the condensed light is made flickering to achieve an effect of seeking help by flickering.

In addition, when it is necessary to remove the illuminating structure from the hat body 1, by applying an acting force to the illuminating structure, the illuminating structure is detached from the surface of the folded-edge portion 2 by the acting force, thereby detaching the illuminating structure from the hat body 1, and completing the step of detaching the illuminating structure to facilitate subsequent steps of cleaning, arranging, folding or containing the hat body 1.

Example II

With reference to FIGS. 1-7, in this embodiment, an illuminating knitted hat is implemented, comprising a hat body 1 and an illuminating structure, wherein one end of the hat body 1 is a folded-edge portion 2, the illuminating structure is mounted on the surface of the folded-edge portion 2, the illuminating structure comprises a light-condensing component, a light-scattering component and a main control circuit board 3, a switching button 4 is electrically connected to the surface of the main control circuit board 3, the switching button 4 is used for switching the light-condensing or light-scattering function, a protection component for protecting the illuminating structure is mounted on the outside of the illuminating structure, the protection component is mounted on the surface of the folded-edge portion 2, and one end of the main control circuit board 3 is electrically connected to a charging interface 5 for connecting an external power supply, and a protection component is provided outside the charging interface 5.

The protection component comprises a sheath 6 and anti-slip threads 7, wherein the sheath 6 and the charging interface 5 are of a detachable structure, the anti-slip thread 7 is located on the surface of the sheath 6, the anti-slip thread 7 is used for increasing the friction force on the surface of the sheath 6, the anti-slip thread 7 is provided with a 10 plurality of strips, two adjacent anti-slip threads 7 are equidistantly arranged, one end of the sheath 6 is arc shaped, one end of the folded-edge portion 2 can fold along the surface of the hat body 1, the illuminating structure penetrates the surfaces of the two ends of the folded-edge portion 2, and the hat body 1 is composed of a knitted hat, and the illuminating structure can be replaced with a LED lamp.

The light-scattering component is composed of a light panel 9 used for illumination; the light panel 9 is in a rectangular plate shape, electrically connected with the main control circuit board 3 and can achieve a light-scattering function when being powered on with the main control circuit board 3; when a pressing force is applied to the switching button 4, the main control circuit board 3 and the light panel 9 are powered on to form a loop through the switching button 4, so that the light panel 9 is powered on to emit scattered light for illumination, achieving the function of scattering light, and increasing the illumination range of light.

The protection component comprises a protection shell 10 and a protection cushion 11 which are both in an annular sealing shape, the edges of the protection shell 10 and the protection cushion 11 are both arc shaped, one end of the protection cushion 11 is connected to a storage battery 12 electrically connected to a main control circuit board 3, and the storage battery 12 is used for storing an external power source connected to a charging interface 5; the protection shell 10 is mounted at one end of a folded-edge portion 2, the protection cushion 11 is mounted at the other end of the folded-edge portion 2, and when the charging interface 5 is connected to the external power source, an auxiliary current is transmitted to the inside of the storage battery 12 via the main control circuit board 3, so that the storage battery 12 completes the function of storing electric energy, facilitating subsequent use by the user; the protection shell 10 and the protection cushion 11 both play the role of protecting the illuminating structure; when an external object has an impact force on the edge of the illuminating structure, the protection shell 10 and the protection cushion 11 play the role of buffering the impact force, thereby reducing the impact force on the edge of the illuminating structure to achieve the effect of reducing damage.

A bluetooth positioning module 13 is electrically connected to the surface of the main control circuit board 3 and is used for assisting wireless positioning of a signal, one end of the main control circuit board 3 is provided with a rectifying diode 14 electrically connected thereto, the rectifying diode 14 is provided with a plurality of strips, and two adjacent rectifying diodes 14 are arranged equidistantly; the rectifier diode is a semiconductor device for converting alternating current energy into direct current energy, the rectifier diode comprises a PN junction, and has two terminals of a positive electrode and a negative electrode, and the most important characteristic of the rectifier diode is one-way conductivity. In a circuit, the current can only flow in from the positive electrode and the negative electrode of the rectifier diode 14 to maintain the stability of the current, play the role of sorting the current, and achieve the effect of avoiding the load or overload of the main control circuit board 3.

The Bluetooth positioning module 13 uses the RSSI positioning principle, and the Bluetooth positioning is based on the Received Signal Strength Indication (RSSI) positioning principle; according to different positioning ends, the Bluetooth positioning modes are divided into network side positioning and terminal side positioning;

a network side positioning system is composed of a terminal (a terminal with low-power Bluetooth such as a mobile phone), a Bluetooth beacon node, a Bluetooth gateway, a wireless local area network and a back-end data server, and the specific positioning process thereof is:

1) firstly, the beacon and Bluetooth gateways are laid in the region;

2) when a terminal enters a beacon signal coverage range, the terminal can sense a broadcast signal of the beacon, and then calculate a RSSI value under a certain beacon, and transmit same to a back-end data server via a Bluetooth gateway via a WiFi network, and calculate a specific position of the terminal via a built-in positioning algorithm of the server;

Terminal side positioning system is composed of terminal device (such as mobile phone embedded with SDK software package) and beacon. Its specific positioning principle is:

1) firstly, a Bluetooth beacon is laid in an area;

2) beacon continuously broadcasts signals and data packets to the surroundings:

3) when a terminal device enters a range covered by a beacon signal, RSSI values thereof for different base stations are measured, and then a specific position is calculated via a built-in positioning algorithm of a mobile phone.

All the devices connected together by Bluetooth technology are referred to as a piconet, and a plurality of piconets can be connected together; each piconet is identified by a frequency hopping sequence, and all users of the same piconet are synchronized with this frequency hopping sequence; piconet refers to a micro-network composed of various electric appliances with a Bluetooth unit (i.e., a Bluetooth positioning module embedded in various electric appliance devices supporting Bluetooth technology) in a small range (10-100 m) using Bluetooth technology, commonly referred to as a piconet;

a piconet is composed of 2-8 Bluetooth units, i.e., a piconet composed of one main appliance and other 2-7 secondary appliances can be composed; these appliances may be PCs, printers, fax machines, digital cameras, mobile phones, notebook computers, etc.; a plurality of piconets can also be interconnected to form a Scatternet to conveniently and quickly realize the communication between various types of devices at any time and anywhere; a path is formed by a Bluetooth positioning module 13 and a separate contact on a main control circuit board 3, so that the Bluetooth positioning module 13 sends out a wireless signal; when an external sensor senses a wireless signal, an external positioning device in a standby state is activated.

After the wireless signal monitored by the external positioning device is converted into an electrical signal by baseband chip analysis processing, the signal is transmitted to the positioning controller through the radio frequency chip, and thereafter the working mode is controlled by wired control; after the wireless signal is centrally determined, processed, calculated and confirmed by the external controller, corresponding positioning and control work is performed, and the positioning process through the Bluetooth positioning module 13 is completed.

A reinforcement portion 15 for reinforcing the hat body 1 is connected to the edge of the hat body 1, the arc of the reinforcement portion 15 coincides with the arc of the hat body 1, and one end of the reinforcement portion 15 extends to an edge of the folded-edge portion 2 and abuts against the edge of the folded-edge portion 2; increasing the thickness of the edge of the hat body 1 by the reinforcement portion 15 has the effect of supporting the hat body 1 as a whole, achieving the function of stabilizing the hat body 1, relieving collapses of the hat body 1 when standing, and having the effect of increasing practicality, and at the same time, reducing the probability of deformation of the hat body 1 by the reinforcement portion 15 when wearing, and having the effect of improving aesthetics.

The surface of the folded-edge portion 2 is provided with a plurality of contact threads 16 for increasing friction, wherein the contact threads 16 are in an annular sealing shape, and two adjacent contact threads 16 are arranged at an equal distance; the contact threads 16 serve to increase the contact point between the surface of the folded-edge portion 2 and the surface of the hat body 1, thereby serving to increase the friction, reduce the phenomenon that the folded-edge portion 2 slides off from the surface of the hat body 1, facilitate daily use of the hat body 1 and facilitate finishing by a user, and reduce the process of finishing the folded-edge portion 2 sliding off; one end of the folded-edge portion 2 away from the illuminating structure is provided with a storage bag 17, and structure of the storage bag 17 is symmetrically mounted on the surface of the folded-edge portion 2; one end of the storage bag 17 is opened, and the interior of the storage bag 17 can hold an article, wherein the article comprises a paper, a coin, a signature pen or a card.

The hat body 1 and the illuminating structure are detachable structures, the hat body 1 is a foldable structure, and the top of the hat body 1 is arc shaped; when it is necessary to remove the illuminating structure from the hat body 1, by applying an acting force to the illuminating structure, the illuminating structure is detached from the surface of the folded-edge portion 2 by the acting force, thereby detaching the illuminating structure from the hat body 1, and completing the step of detaching the illuminating structure to facilitate subsequent steps of cleaning, arranging, folding or containing the hat body 1.

A transfer contact 18 is provided on the surface of the main control circuit board 3, is located in the middle of the main control circuit board 3, is electrically connected to the main control circuit board 3 and is used for switching the power supply of the light-scattering component; when the transfer contact 18 and the light-scattering component are powered on to form a loop, the light-scattering component is powered on by being switched on to generate scattered light for illumination.

The point of this embodiment is that when a pressing force is applied to the switching button 4, the main control circuit board 3 and the light panel 9 are powered on to form a loop by the switching button 4, so that the light panel 9 is powered on to emit scattered light, and the scattered light is used for illumination, achieving the function of scattering light, increasing the illumination range of light, achieving the function of diffuse reflection and soft light, reducing the effect of strong dazzling caused by light concentration, and using soft illumination of scattering light, reducing the degree of dazzling light, and increasing the practicality and diversity of products.

In addition, when it is necessary to remove the illuminating structure from the hat body 1, by applying an acting force to the illuminating structure, the illuminating structure is detached from the surface of the folded-edge portion 2 by the acting force, thereby detaching the illuminating structure from the hat body 1, and completing the step of detaching the illuminating structure to facilitate subsequent steps of cleaning, arranging, folding or containing the hat body 1.

The foregoing is a further detailed description of the invention, taken in conjunction with specific preferred embodiments, and is not to be construed as limiting the invention. It will be apparent to a person skilled in the art that various deductions and replacements can be made in the present invention without departing from the conception of the disclosure.

What is claimed is:

1. An illuminating knitted hat, comprising a hat body and an illuminating structure, wherein one end of the hat body is a folded-edge portion, the illuminating structure is mounted on the surface of the folded-edge portion, the illuminating structure comprises a light-condensing component, a light-scattering component and a main control circuit board, a switching button is electrically connected to the surface of the main control circuit board, the switching button is used for switching the light-condensing or light-scattering function, a protection component for protecting the illuminating structure is mounted on the outside of the illuminating structure, the protection component is mounted on the surface of the folded-edge portion, and one end of the main control circuit board is electrically connected to a charging interface for connecting an external power supply;

the light-condensing component is composed of a plurality of lampwicks used for illumination, the lampwicks are rectangular, arranged in a rectangular array, are electrically connected to a main control circuit board, and can achieve a light-condensing function when being powered on with the main control circuit board.

2. The illuminating knitted hat according to claim 1, wherein the light-scattering component is composed of a light panel used for illumination, the light panel is in a rectangular plate shape, is electrically connected to the main control circuit board, and can achieve a light-scattering function when being powered on with the main control circuit board.

3. The illuminating knitted hat according to claim 1, wherein the protection component comprises a protection shell and a protection cushion which are both in an annular sealing shape, the edges of the protection shell and the protection cushion are both arc shaped, one end of the protection cushion is connected to a storage battery electrically connected to a main control circuit board, and the storage battery is used for storing an external power source connected to a charging interface.

4. The illuminating knitted hat according to claim 1, wherein a bluetooth positioning module is electrically connected to the surface of the main control circuit board and is used for assisting wireless positioning of a signal, one end of the main control circuit board is provided with a rectifying diode electrically connected thereto, the rectifying diode is provided with a plurality of strips, and two adjacent rectifying diodes are arranged equidistantly.

5. The illuminating knitted hat according to claim 1, wherein a reinforcement portion for reinforcing the hat body is connected to the edge of the hat body, an arc of the reinforcement portion coincides with an arc of the hat body, and one end of the reinforcement portion extends to an edge of the folded-edge portion and abuts against the edge of the folded-edge portion.

6. The illuminating knitted hat according to claim 1, wherein a plurality of contact threads for increasing friction are provided on the surface of the folded-edge portion, wherein the contact threads are in an annular sealing shape, two adjacent contact threads are equidistantly arranged, one end of the folded-edge portion away from the illuminating structure is provided with a storage bag, structure of the storage bag is symmetrically mounted on the surface of the folded-edge portion, and one end of the storage bag is in an open shape.

7. The illuminating knitted hat according to claim 1, wherein the hat body and the illuminating structure are detachable structures, the hat body is a foldable structure, and the top of the hat body is arc shaped.

8. The illuminating knitted hat according to claim 1, wherein the surface of the main control circuit board is provided with a transfer contact located in the middle of the main control circuit board and is electrically connected to the main control circuit board, and the transfer contact is used for switching the power supply of the light-condensing component or the light-scattering component.

9. The illuminating knitted hat according to claim 1, wherein a protection component is provided outside the charging interface; the protection component comprises a sheath and anti-slip threads, wherein the sheath and the charging interface are of a detachable structure, the anti-slip threads are located on the surface of the sheath, used for increasing the friction force on the surface of the sheath, and provided with a plurality of strips, two adjacent anti-slip threads are equidistantly arranged, one end of the sheath is arc shaped, one end of the folded-edge portion can fold along the surface of the hat body, the illuminating structure penetrates the surfaces of the two ends of the folded-edge portion, and the hat body is composed of a knitted hat.

* * * * *